US010989501B2

(12) United States Patent
Glikin et al.

(10) Patent No.: US 10,989,501 B2
(45) Date of Patent: Apr. 27, 2021

(54) REACTIVE ARMOUR

(71) Applicant: RAFAEL ADVANCED DEFENSE SYSTEMS LTD., Haifa (IL)

(72) Inventors: Leonid Glikin, Shechania (IL); Iris Silberman, Shimshit (IL); Samuel Friling, Kfar Vradim (IL); Moshe Benyami, Haifa (IL)

(73) Assignee: RAFAEL ADVANCED DEFENSE SYSTEMS LTD., Haifa (IL)

( * ) Notice: Subject to any disclaimer, the term of this patent is extended or adjusted under 35 U.S.C. 154(b) by 0 days.

(21) Appl. No.: 16/454,712

(22) Filed: Jun. 27, 2019

(65) Prior Publication Data

US 2020/0072579 A1 Mar. 5, 2020

Related U.S. Application Data

(63) Continuation-in-part of application No. PCT/IL2017/051390, filed on Dec. 27, 2017.

(30) Foreign Application Priority Data

Dec. 29, 2016 (IL) ..... 249859

(51) Int. Cl.
*F41H 5/007* (2006.01)

(52) U.S. Cl.
CPC ..... *F41H 5/007* (2013.01)

(58) Field of Classification Search
CPC ..... F41H 5/007
USPC ..... 89/36.17
See application file for complete search history.

(56) References Cited

U.S. PATENT DOCUMENTS

| | | | | |
|---|---|---|---|---|
| 4,869,152 | A | 9/1989 | Marlow et al. | |
| 5,910,638 | A | 6/1999 | Spencer et al. | |
| 5,922,986 | A | 7/1999 | Wanninger et al. | |
| 6,932,878 | B1 * | 8/2005 | Hallam | C06B 45/10 149/19.91 |
| 7,854,811 | B1 * | 12/2010 | Wartman | C06B 21/0025 149/109.6 |
| 2006/0162539 | A1 | 7/2006 | Fucke et al. | |
| 2011/0083776 | A1 | 4/2011 | Daoud et al. | |
| 2012/0266745 | A1 | 10/2012 | Warren | |

FOREIGN PATENT DOCUMENTS

| | | | |
|---|---|---|---|
| EA | 200301266 | A1 | 2/2005 |
| EP | 0299253 | A1 | 1/1989 |
| EP | 0860678 | A1 | 8/1998 |
| GB | 1554636 | A | 10/1979 |
| WO | 20060109304 | A2 | 10/2006 |

OTHER PUBLICATIONS

International Search Report for the related Application No. PCT/IL2017/051390 dated Dec. 27, 2017.
Supplemental International Search Report for the related Application No. PCT/IL2017/051390 dated Jul. 27, 2020, 6 pages.

* cited by examiner

*Primary Examiner* — Reginald S Tillman, Jr.
(74) *Attorney, Agent, or Firm* — Honigman LLP; Brett A. Krueger

(57) ABSTRACT

A flexible protection element for reactive protection against shaped charge warheads and kinetic energy projectiles comprises a formable doughy mixture of a powder dispersed within a matrix of plastic explosive and a binder.

20 Claims, 2 Drawing Sheets

REACTIVE ARMOUR

TECHNICAL FIELD

The present disclosure relates to the field of reactive armour, More particularly, the disclosure relates to a shapeable material for reactive surfaces and to a process for its preparation.

BACKGROUND

Reactive armour has been employed in the art for quite some time to defend against attacks by a variety of anti-tank charges (which are used against all kinds of armoured vehicles) and to reduce the damage done to the vehicle being protected. It is most effective in protecting against shaped charge warheads and kinetic energy penetrators.

An element of explosive reactive armour consists of an explosive layer sheet or slab of high explosive sandwiched between two plates, typically metal ones. When hit by anti-armour threat, either Shaped Charge warheads or Long Rod penetrators, the explosive detonates, forcibly driving the metal plates apart to damage the penetrator. Against a shaped charge, the projected plates disrupt the metallic jet penetrator, effectively providing a greater path-length of material to be penetrated. Against a kinetic energy penetrator, the projected plates serve to deflect and break up the rod.

The disruption is attributed mainly to the following mechanism. Since the plates are angled with respect to the impact direction of shaped charge warheads, as the plates move outwards the impact point, the plates move continuously over time, requiring the jet to cut through additional fresh plate material. This effect actually increases the effective plate thickness during the impact.

A complication to the use of reactive armour is the hazardous risks to the surroundings—dismounted troops or vehicles, due to fragments or moving plates emanating from the explosive detonation. Another complication is that conventional reactive armour is made of flat plates and is not suited to protect non-planar surfaces. It would therefore be highly desirable to provide new reactive armour that reduces the collateral damage effects to the surroundings and which can also be easily applied to non-planar surfaces.

SUMMARY

The disclosure relates to a rigid or flexible protection element for reactive protection against shaped charge warheads and kinetic energy projectiles, comprising a powder dispersed within a matrix of plastic explosive and a binder, which can be utilized as a stand-alone protection element or as a part of protection system such as reactive cassette.

In some implementations, the protection element is a flexible protection element that comprises a formable doughy mixture of a powder dispersed within a matrix of plastic explosive and a binder, wherein said doughy mixture contains 23 to 33 wt % of said plastic explosive, 64 to 74 wt % of said powder, and 2 to 4 wt % of said binder.

In some implementations, the protection element is of a single layer when utilized as a stand-alone protection element. The protection element may be coated by explosive material or by fragments in one or more layers that are caused to be propelled in different directions to damage or disrupt a penetrator.

In some implementations, the protection element comprises two or more layers of the formable doughy mixture, each of which coated by explosive material or by fragments that are caused to be propelled in different directions to damage or disrupt a penetrator, wherein each pair of adjacent layers are attached together by adhesive or bonding material. The protection element may further comprise one or more explosive sheets, each of which coated by explosive material or by fragments that are caused to be propelled in different directions to damage or disrupt a penetrator, wherein each of the explosive sheets is attached to an adjacent layer of the formable doughy mixture or to an adjacent explosive sheet by adhesive or bonding material.

In some implementations, one or more faces of the protection element is attached to a corresponding external metallic layer or to a corresponding external non-metallic layer, such as a ceramic layer, a composite layer, or a polymeric layer.

The protection element may be utilized as a part of a protection system such as a reactive cassette.

In some implementations, the protection element of the disclosure is configured to be at least partially detonated, for example fully detonated, upon impact by a shaped charge warhead or a kinetic energy projectile.

In additional implementations, the protection element is configured to be only locally detonated upon impact by a shaped charge warhead or kinetic energy projectile.

The protection element can have a distribution of the powder within the matrix which is homogeneous, or one which is non-homogeneous.

The disclosure also encompasses a combination of several reactive elements as described above, which differ in the amount of the powder dispersed within the matrix of plastic explosive and binder.

In another aspect, the disclosure is directed to a protection element in which the explosive is homogeneously dispersed throughout the entire area of the cross section and in a further embodiment of the disclosure there is provided a protection element in which the explosive is dispersed in different concentrations throughout the entire area of the cross section. Moreover, in another aspect, the protection element is designed such that the explosive is dispersed only in partial region of a cross section of the element.

In yet another aspect, the protection element is planar or non-planar in shape.

In another aspect, the protection element has a uniform or non-uniform thickness.

The powder may be selected from the group consisting of metallic powder, ceramic powder, polymer powder, glass powder, and a combination thereof.

In another aspect, the metallic powder, ceramic powder and glass powder have an average grain or particle size ranging from 10 to 200 micrometers (μm).

The metallic powder has a bulk density ranging from 2.6 to 19.5 g/cc, the ceramic powder has a bulk density ranging from 1.5 to 17.5 g/cc, and the glass powder has a bulk density ranging from 2.0 to 5.0 g/cc.

In another aspect, the metallic powder is a tungsten powder, and a median diameter of tungsten particles is approximately 120 μm.

In another aspect, the metallic powder is a tungsten carbide powder, and a mean diameter of tungsten carbide particles is approximately 80 μm.

In another aspect, the polymer powder has an average grain or particle size ranging from 20 to 400 μm and a bulk density ranging from 1.0 to 3.0 g/cc.

While the disclosure is not limited to any specific explosive, in some implementations, the plastic explosive material is selected from Octahydro-1,3,5,7-tetranitro-1,3,5,7-tetrazocine (HMX) and 1,3,5-Trinitroperhydro-1,3,5-triazine (RDX).

Similarly, the solid particles can have a variety of shapes, and according to one embodiment of the disclosure the particles have an essentially round shape.

Binders suitable for use with the disclosure will be recognized by the skilled person. According to one embodiment of the disclosure the binder is selected from among Hydroxyl-terminated polybutadiene (HTPB), polyurethane, polyester, polyether, acrylic, fluoroelastomers, polyisobutene and Polydimethylsiloxane (PDMS).

In another aspect, the protection element is formed into a flexible sheet.

In another aspect, the protection element is a reactive layer.

The disclosure further encompasses a protective structure for protecting a structure by the reactive layer, including but not limited to vehicles, buildings and vessels. In some implementations, at least part of the protected surface is rounded or wavy.

DETAILED DESCRIPTION

Figure 1:
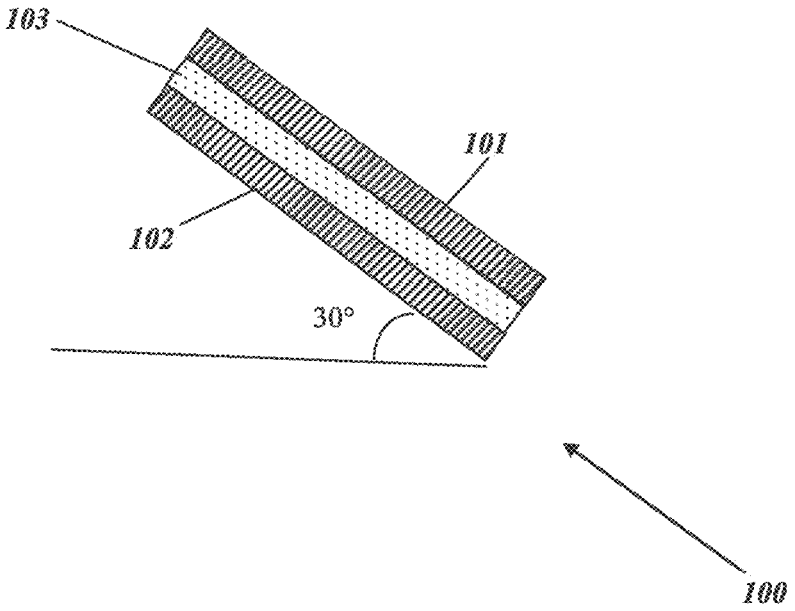
FIG. 1 schematically illustrates typical reactive armour.

FIG. 1 schematically illustrates a typical reactive armour 100, which consists of upper metal plate 101, bottom metal plate 102, and explosive layer 103, sandwiched between them. Alternatively, upper plate 101 and bottom plate 102 may be made of non-metallic material, such as ceramic material, composite material, or polymeric material. A typical angle at which the reactive armour is positioned is 30° relative to the ground. According to the disclosure this set-up can be maintained, if desired, but the intermediate layer of explosive material can also be used as a stand-alone protection element without adding the metal or non-metallic plates, while maintaining the efficiency of protection. This is particularly important when it is desired to protect a non-planar (e.g. curved) surface such as a tank turret.

Figure 2:
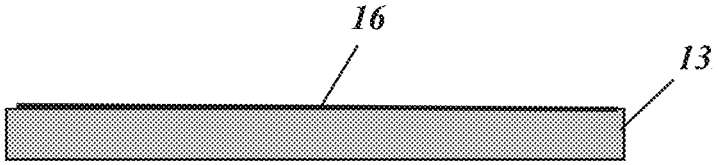
FIG. 2 schematically illustrates a single-layer protection element.

FIG. 2 illustrates a single-layer protection element 13, which may be made of a formable doughy mixture of a powder dispersed within a matrix of plastic explosive and a binder. Protection element 13 may be coated by one or more coating layers 16 made of explosive material or fragments that are caused to be propelled in different directions to damage or disrupt a penetrator, although protection element 13 is also able to maintain its efficiency of protection without a coating layer.

Figure 3:
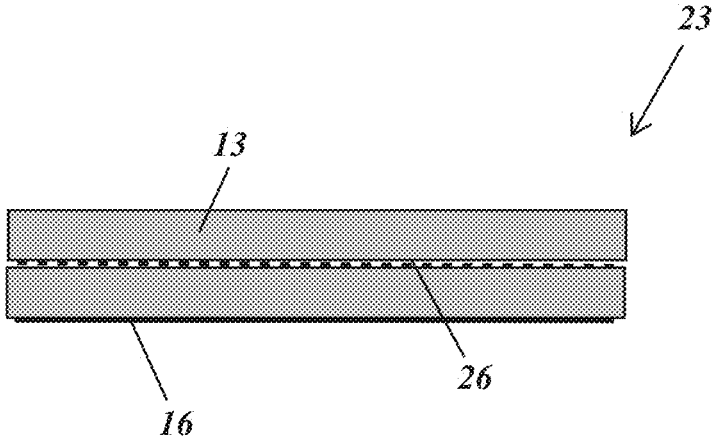
FIG. 3 schematically illustrates a multi-layer protection element.

FIG. 3 illustrates a multi-layer protection element 23 configured with two or more doughy layers 13. Each pair of adjacent doughy layers 13 are attached together by adhesive or bonding material 26. Each doughy layer 13 may be coated by one or more coating layers 16 made of explosive material or fragments that are caused to be propelled in different directions to damage or disrupt a penetrator.

Figure 4:
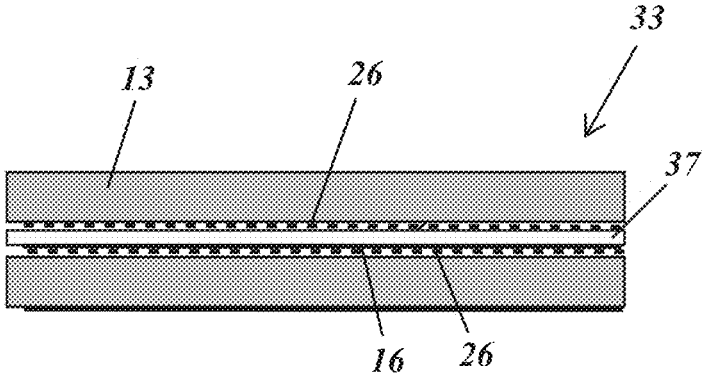
FIG. 4 schematically illustrates another embodiment of a multi-layer protection element.

FIG. 4 illustrates a multi-layer protection element 33 configured with one or more doughy layers 13, and one or more explosive sheets 37. Each explosive sheet 37 is attached to an adjacent doughy layer 13 or to an adjacent explosive sheet by adhesive or bonding material 26. Each explosive sheet 37 may be coated by one or more layers 16 made of explosive material or fragments that are caused to be propelled in different directions to damage or disrupt a penetrator.

A typical reactive component according to the disclosure contains (23-33% on a weight basis) of an explosive material, (64-74% wt) of a particulate solid and (2-4% wt) of a binder, which may be, for instance, HTPB, or a silicon-based or other binder. Binders are well known in the art and, therefore, are not discussed herein in detail, for the sake of brevity. An illustrative example is a reactive material made of 28% wt HMX explosive, 69% wt of tungsten carbide powder with a median diameter of 80 μm and 3% of HTPB. A typical thickness of the resulting reactive layer is in the range of 9-30 mm.

The amount of particulate material to be used according to the disclosure, as well as the size of the particles, may be important. It has been found that a diameter of between 45-180 μm provides a suitable result, although the disclosure is not limited to such sizes, which are provided for the purpose of illustration. The particles can be rounded in shape or can be irregular, in which case the effective diameter is referred to.

The reactive layer can be prepared by a simple process, which involves mixing performed in Planetary-type mixers at 60 rpm and temperature of 50-60° c. The explosive dough produced by mixing is injected in vacuum conditions followed by pressing to explosive sheets in the required thickness. After pressing, the material is cured in an oven, for example at 55° C.±50° C. For safety considerations, all the procedures are preferably performed from a remote control room.

EXAMPLES

All the reactive layers prepared according to the following examples were tested in a standard test using a 30° support and an RPG-7 as the charge. All reactive layers gave results comparable to those of the prior art.

Example 1

HMX Class 3 (19% wt), HMX Class 5 (9% wt) was employed, together with particles of tungsten carbide (69% wt) and HTPB up to 100% wt, to prepare a reactive layer. The particle size distribution of the tungsten carbide was d10=50 μm; d50=80 μm; d90=130 μm and the particles were rounded in shape. Care was taken to obtain a substantially homogeneous distribution of the particles in the mixture. The equipment used was a high shear mixer and an injector and hydraulic press. The process involved the following steps: Raw materials mixing followed by injection and dough pressing to get sheet with appropriate thickness. Final steps are curing and sheet cutting.

Example 2

Example 1 was repeated, with different particles. HMX Class 3 (16% wt), HMX Class 5 (7% wt) were employed, together with tungsten particles (73% wt) and HTPB up to 100% wt, to prepare a reactive layer. The particle size distribution of the tungsten was d10=90 μm; d50=120 μm; d90=170 μm and the particles were rounded in shape. Care was taken to obtain a substantially homogeneous distribution of the particles in the mixture. The equipment used was a high shear mixer and an injector and hydraulic press. The process involved the following steps: Raw materials mixing followed by injection and dough pressing to get sheet with appropriate thickness. Final steps are curing and sheet cutting.

Example 3

Example 2 was repeated with the following parameters: RDX Class 1 (23% wt), RDX Class 5 (10% wt) were employed, together with particles of tungsten (64% wt) and HTPB (3% wt), to prepare a reactive layer. The median particle size of the tungsten was d50=80 μm.

All the above descriptions and examples have been provided for the purpose of illustration and are not intended to limit the disclosure in any way, except as provided for by the appended claims. Many different metal and ceramic materials can be employed, a large range of diameters can be used, and many suitable binders can be utilized, which are known to the skilled person, without exceeding the scope of the disclosure.

Additionally, the explosive of the type described herein may be beneficially used in other applications, where formability into curved structures and minimum collateral damage are important. One such application is the countermeasure of active protection system against shaped-charge missiles warhead or rockets and kinetic penetrators. In the prior art, these countermeasures have employed barrel-launched projectiles, spherical or linear explosively-formed projectiles, fragmentation explosive charge, or blast charge, all of which require very precise aiming and timing, and/or exhibit highly intolerable collateral damage. Use of the explosive according to the disclosure in such countermeasure will assure neutralization of the threat under easier precision constraints of aiming and timing, with minimal collateral damage. Another application of the disclosure is in warheads of precision-guided munitions, which are meant to assure minimal collateral damage.

What is claimed is:

1. A flexible protection element for reactive protection against shaped charge warheads and kinetic energy projectiles, the flexible protection element comprising a formable doughy mixture of a powder dispersed within a matrix of plastic explosive and a binder, wherein said doughy mixture contains 23 to 33 wt % of said plastic explosive, 64 to 74 wt % of said powder, and 2 to 4 wt % of said binder.

2. The flexible protection element of claim 1, which is of a single layer when utilized as a stand-alone protection element.

3. The flexible protection element of claim 2, wherein the single layer is coated by explosive material or by fragments that are caused to be propelled in different directions to damage or disrupt a penetrator.

4. The flexible protection element of claim 1, which comprises two or more layers of the formable doughy mixture, each of which coated by explosive material or by fragments that are caused to be propelled in different directions to damage or disrupt a penetrator, wherein each pair of adjacent layers are attached together by adhesive or bonding material.

5. The flexible protection element of claim 4, further comprising one or more explosive sheets, each of which coated by explosive material or by fragments that are caused to be propelled in different directions to damage or disrupt a penetrator, wherein each of the explosive sheets is attached to an adjacent layer of the formable doughy mixture or to an adjacent explosive sheet by adhesive or bonding material.

6. The flexible protection element of claim 1, wherein one or more faces thereof is attached to a corresponding external metallic layer or to a corresponding external non-metallic layer.

7. The flexible protection element of claim 1, when utilized as a part of a protection system such as a reactive cassette.

8. The flexible protection element of claim 1, which is at least partially detonated, only locally detonated or fully detonated upon impact by a shaped charge warhead or kinetic energy projectile.

9. The flexible protection element of claim 1, in which distribution of the powder within the matrix is homogeneous or non-homogeneous.

10. The flexible protection element of claim 1, in which the explosive is— a) homogeneously dispersed throughout an entire cross section of the element; or
b) dispersed in different concentrations throughout an entire cross section of the element; or
c) dispersed only in a partial region of a cross section of the element.

11. The flexible protection element of claim 1, which is— a) planar; or
b) non-planar in shape; or
c) is formed into a flexible sheet; or
d) has a uniform thickness; or
e) has a non-uniform thickness.

12. The flexible protection element of claim 1, wherein the powder is selected from the group consisting of metallic powder, ceramic powder, polymer powder, glass powder, and a combination thereof.

13. The flexible protection element of claim 12, wherein— a) the metallic powder, ceramic powder and glass powder have an average grain or particle size ranging from 10 to 200 μm; or
b) the metallic powder has a bulk density ranging from 2.6 to 19.5 g/cc; or
c) the metallic powder is a tungsten powder; or
d) a median diameter of tungsten particles is approximately 120 μm; or
e) the metallic powder is a tungsten carbide powder; or
f) a mean diameter of tungsten carbide particles is approximately 80 μm; or
g) the ceramic powder has a bulk density ranging from 1.5 to 17.5 g/cc; or
h) the glass powder has a bulk density ranging from 2.0 to 5.0 g/cc; or
i) the polymer powder has an average grain or particle size ranging from 20 to 400 μm and a bulk density ranging from 1.0 to 3.0 g/cc.

14. The flexible protection element of claim 1, wherein the plastic explosive is selected from HMX and RDX.

15. The flexible protection element of claim 1, wherein particles of the powder have an essentially round shape.

16. The flexible protection element of claim 1, wherein the binder is selected from among HTPB, polyurethane, polyester, polyether, acrylic, fluoroelastomers, polyisobutene and PDMS.

17. The flexible protection element of claim 1, which is a reactive layer.

18. A protective structure for protecting a structure by the reactive layer according to claim 17.

19. The structure according to claim 18— a) which is a vehicle; or b) which is a building; or c) which is a vessel; or d) wherein at least part of its surface is rounded or wavy.

20. A combination of several elements, each one as claimed in claim 1, which differ in an amount of the powder dispersed within the matrix of plastic explosive and binder.

* * * * *